US006776147B2

(12) United States Patent
Tsunenaga et al.

(10) Patent No.: US 6,776,147 B2
(45) Date of Patent: Aug. 17, 2004

(54) IGNITION COIL ASSEMBLY FOR ENGINE

(75) Inventors: Koji Tsunenaga, Chiryu (JP); Yoshihiro Shimoide, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/456,470

(22) Filed: Jun. 9, 2003

(65) Prior Publication Data

US 2004/0123852 A1 Jul. 1, 2004

(30) Foreign Application Priority Data

Jun. 12, 2002 (JP) ..... 2002-171254

(51) Int. Cl.[7] ..... F02P 3/02
(52) U.S. Cl. ..... 123/635; 336/67
(58) Field of Search ..... 123/634, 635, 123/643, 647; 336/65, 67

(56) References Cited

U.S. PATENT DOCUMENTS 5,109,828 A * 5/1992 Tagami et al. ..... 123/635
5,152,274 A * 10/1992 Maekawa ..... 123/635
6,149,336 A * 11/2000 Bartley et al. ..... 123/635
6,543,430 B2 * 4/2003 Moga et al. ..... 123/634
6,675,786 B2 * 1/2004 Tsunenaga et al. ..... 123/635

FOREIGN PATENT DOCUMENTS

JP 9-250437 9/1997

* cited by examiner

*Primary Examiner*—Tony M. Argenbright
(74) *Attorney, Agent, or Firm*—Nixon & Vanderhye P.C.

(57) ABSTRACT

In an ignition coil assembly, a plurality of ignition coils is arranged to be electrically connected to spark plugs received in plug holes of an engine. A base cover includes a plurality of receiving through holes, which are arranged at corresponding positions that correspond to positions of the plug holes, respectively. A top cover covers a top surface of the base cover and secures each ignition coil through engagement with the head of each ignition coil. Fastening bolts temporarily fasten the top cover and the base cover in a manner that allows sliding adjustment of a securing position of each ignition coil, which is loosely received in a corresponding one of the base cover through holes, in an imaginary plane that is perpendicular to an axis of each ignition coil.

6 Claims, 6 Drawing Sheets

IGNITION COIL ASSEMBLY FOR ENGINE

CROSS REFERENCE TO RELATED APPLICATION

This application is based on and incorporates herein by reference Japanese Patent Application No. 2002-171254 filed on Jun. 12, 2002.

BACKGROUND OF THE INVENTION

1. Field of the Invention

The present invention generally relates to an ignition coil device for an engine of, for example, an automobile and more specifically to an ignition coil assembly that includes a plurality of ignition coils, which are connected to corresponding spark plugs securely installed in plug holes of the engine.

2. Description of Related Art

For example, Japanese Unexamined Patent Publication No. 9-250437 discloses an integrated connector block, in which connectors for supplying electricity to corresponding ignition coils are integrated. The integrated connector block includes a connector block main body, which is formed as an elongated body made of a resin material. Coil connectors are integrally formed in a lower surface of the connector block main body. Each ignition coil, which is secured to a corresponding spark plug installed in an engine, is installed to and is thus engaged with a corresponding one of the coil connectors in an axial direction of the corresponding ignition coil, i.e., in an axial direction of the corresponding spark plug.

Furthermore, in order to allow installation of the ignition coils to the plug holes of the engine in a single step, an ignition coil assembly, which includes a plurality of ignition coils arranged at predetermined intervals, has been proposed. For example, as shown in FIG. 8, one such ignition coil assembly 51 includes a resin base member 53 that holds a plurality of ignition coils 52 at corresponding positions, which correspond to positions of plug holes 131 of an engine 130. Each ignition coil 52 may be threadably secured to the base member 53 through use of a bolt. Alternatively, each ignition coil 52 and the base member 53 may be integrally molded using a resin material. In either way, each ignition coil 52 and the base member 53 are integrated together. Thereafter, the ignition coil assembly 51 is installed to the engine 130 by axially installing the ignition coils 52 into the corresponding plug holes 131, and longitudinal ends and the center of the base member 53 are secured to the engine 130 by bolts 53*c*. The bolts 53*c* are received through corresponding through holes 53*a* of the base member 53 and are threadably engaged with screw holes 132 of the engine 130.

However, in the previously proposed ignition coil assembly 51, manufacturing errors in the intervals (plug hole pitches) of the plug holes 131 of the engine 130 and manufacturing errors in the intervals (securing point pitches) of the ignition coils 52 need to be minimized, resulting in a difficulty in manufacturing of the ignition coil assembly. That is, when there is a substantial deviation between the plug hole pitches of the plug holes 131 and the securing point pitches of the ignition coils 52, it could happen that each ignition coil 52 secured to the base member 53 cannot be linearly inserted into the corresponding plug hole 131.

SUMMARY OF THE INVENTION

The present invention addresses the above disadvantage. Thus, it is an objective of the present invention to provide an ignition coil assembly that allows sliding adjustment of a securing position of each ignition coil in an imaginary plane that is perpendicular to an axis of the ignition coil.

To achieve the objective of the present invention, there is provided an ignition coil assembly for an engine. The engine includes a plurality of plug holes, each of which receives a corresponding one of a plurality of spark plugs. The ignition coil assembly includes a plurality of ignition coils, a base cover, a top cover and a temporarily fastening member. The ignition coils are arranged to be electrically connected to the spark plugs, respectively. Each ignition coil includes a head and a main body, which extends from the head. The base cover includes a plurality of receiving through holes, which penetrate through the base cover and are arranged at corresponding positions that correspond to positions of the plug holes, respectively. The main body of each ignition coil is received through a corresponding one of the receiving through holes such that a gap is defined between the main body of each ignition coil and an inner peripheral wall of the corresponding one of the receiving through holes. The head of each ignition coil is supported by the base cover around a peripheral edge of the corresponding one of the receiving through holes. The top cover covers a top surface of the base cover and secures each ignition coil through engagement with the head of each ignition coil. The temporarily fastening member temporarily fastens the top cover and the base cover in a manner that allows sliding adjustment of a securing position of each ignition coil in an imaginary plane that is perpendicular to an axis of each ignition coil.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

First Embodiment

An ignition coil assembly 1 according to a first embodiment of the present invention will be described with reference to FIGS. 1 to 4.

The ignition coil assembly 1 is for an automobile engine and includes a plurality of ignition coils 2, which are arranged at predetermined intervals and are axially connected to corresponding spark plugs securely received in plug holes of the engine.

Figure 1:
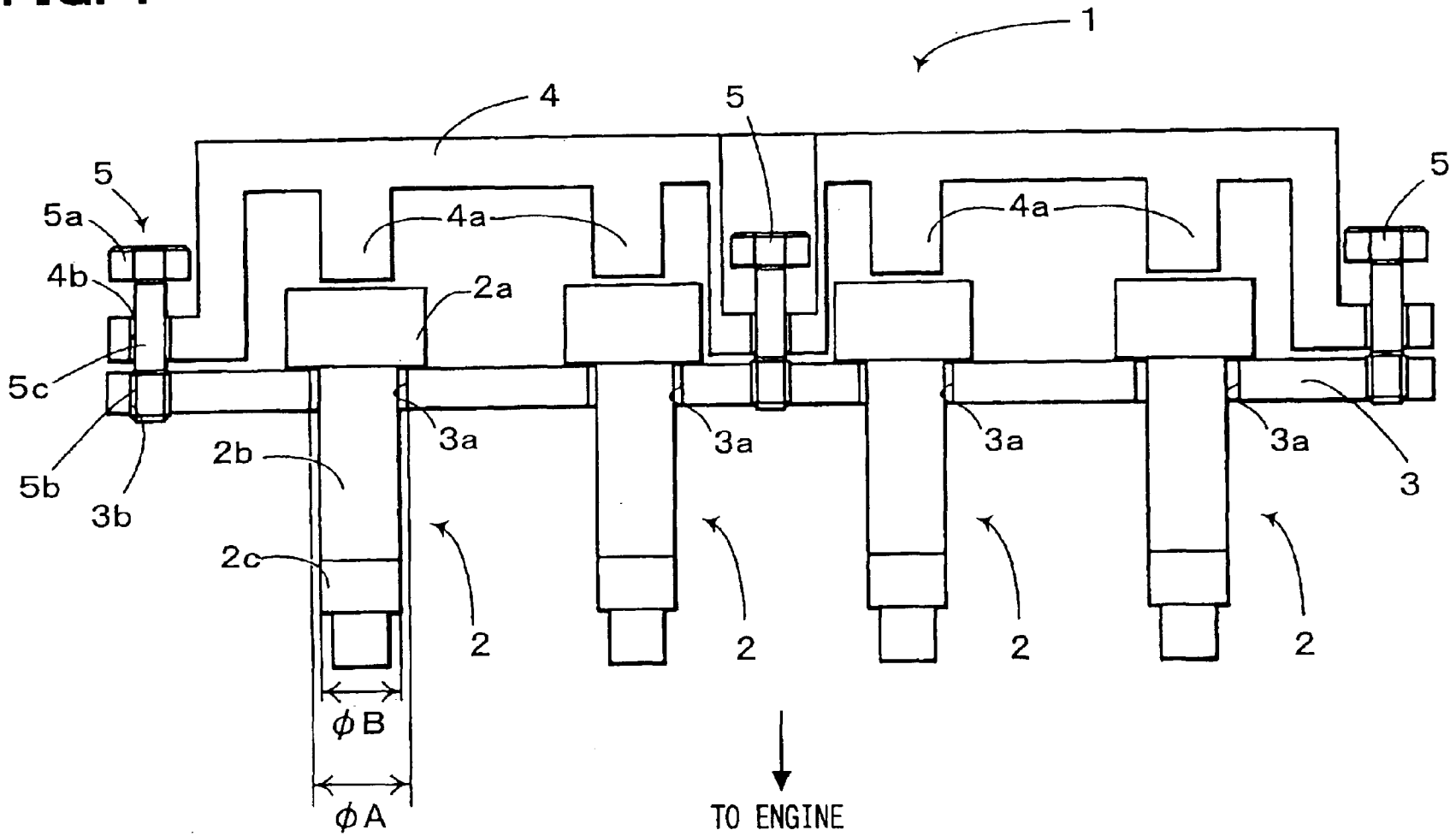
FIG. 1 is a schematic side view of an ignition coil assembly according to a first embodiment of the present invention, showing a state where a top cover and a base cover of the ignition coil assembly are temporarily fastened.

That is, as shown in FIGS. 1 to 4, the ignition coil assembly 1 includes the ignition coils 2, a base cover 3, a top cover 4 and three fastening bolts. The base cover 3 supports the ignition coils 2 at predetermined intervals. The top cover 4 is arranged to cover a top surface of the base cover 3. The fastening bolts 5 serve as fastening screws that secure both the base cover 3 and the top cover 4 to the engine 30. It should be understood that the ignition coil assembly 1 shown in FIG. 1 is for a four cylinder engine and thus includes four ignition coils 2.

Each ignition coil 2 is formed as a stick shaped component that has a case, which is made of a dielectric resin material and receives an electric circuit for generating high voltage to be supplied to the corresponding spark plug 32. As shown in FIG. 1, each ignition coil 2 includes a head 2*a*, a cylindrical main body 2*b* and a tubular plug cap 2*c*. The head 2*a* is arranged at the top end of the ignition coil 2. The cylindrical main body 2*b* extends downwardly from the head 2*a*. The tubular plug cap 2*c* is connected to the lower end of the main body 2*b*.

The head 2*a* is formed as a generally cubic body. A size of the head 2*a*, i.e., a diameter of the circumcircle, which passes through all vertices of the head 2*a* in a plane that is perpendicular to the axis of the ignition coil 2, is greater than the inner diameter of a corresponding one of the plug holes 31 of the engine 30. A connector (not shown) projects laterally from one side of the head 2*a* of each ignition coil 2. The connector of each ignition coil 2 is connected to a connector of a cord electrically connected to a battery (not shown) to allow supply of electric current to the ignition coil 2. The connectors are not shown in FIG. 1 since each connector is located on a back side of the head 2*a* of the corresponding ignition coil 2.

The cylindrical main body 2*b* has the outer diameter smaller than the size of the head 2*a* and is inserted into the corresponding plug hole 31. Thus, each ignition coil 2 is installed to the base cover 3 such that the main body 2*b* of the ignition coil 2 is inserted through a corresponding one of receiving through holes 3*a* of the base cover 3, and the head 2*a* is placed over the top surface of the base cover 3 around the corresponding one of the receiving through holes 3*a*.

The tubular plug cap 2*c* is formed as a tubular body made of a resilient material, such as a rubber material. When the ignition coil 2 is inserted into the corresponding plug hole 31, an inner peripheral surface of the plug cap 2*c* of the ignition coil 2 receives a top end of the corresponding spark plug 32 such that the ignition coil 2 and the spark plug 32 are connected to each other. Each of the plug cap 2*c* and the main body 2*b* has a corresponding internal engaging structure that allows secure engagement between the plug cap 2*c* and the main body 2*b* at the inside thereof. The plug cap 2*c* and the main body 2*b* are securely engaged with each other in a manner that prevents disengagement of the plug cap 2*c* from the main body 2*b* even when the plug cap 2*c* is axially pulled in a direction away from the main body 2*b*.

Figure 3A:
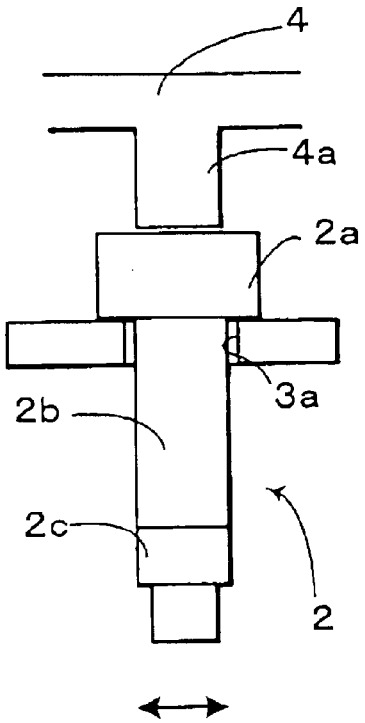
FIG. 3A is an enlarged schematic view showing an ignition coil positioned in the center of a corresponding receiving through hole of the base cover.
Figure 3B:
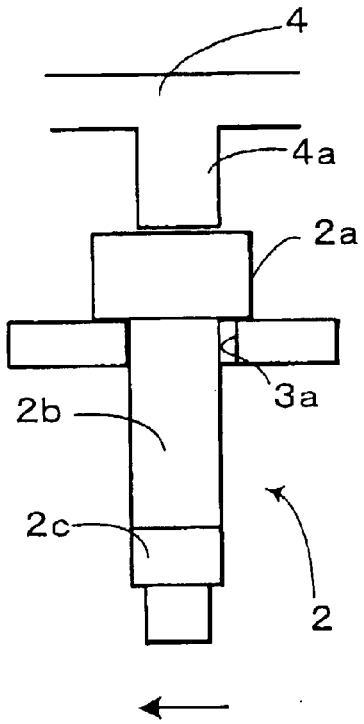
FIG. 3B is an enlarged schematic view showing the ignition coil positioned in the left side in the receiving through hole of the base cover.
Figure 3C:
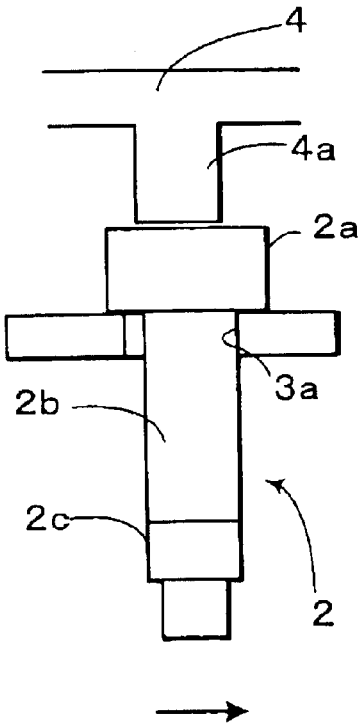
FIG. 3C is an enlarged schematic view showing the ignition coil positioned in the right side in the receiving through hole of the base cover.
Figure 4:
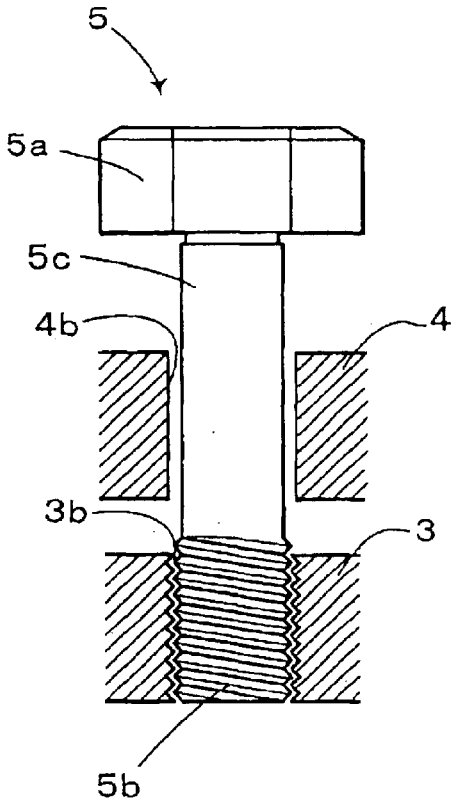
FIG. 4 is an enlarged schematic view showing a structure for temporarily fastening the top cover and the base cover.

The base cover 3 is an elongated plate like body made of, for example, a dielectric resin material. The receiving through holes 3*a* of the base cover 3 are arranged at corresponding positions that correspond to positions of the plug holes 31 of the engine 30 and receive the main body 2*b* of the corresponding ignition coil 2. The inner diameter $\phi A$ of each receiving through hole 3*a* is greater than the outer diameter $\phi B$ of the corresponding main body 2*b* such that the main body 2*b* is loosely received through the receiving through hole 3*a*. Thus, when the main body 2*b* is received through the receiving through hole 3*a*, there is provided play (or a gap), which corresponds to $\phi A-\phi B$, between the main body 2*b* and an inner peripheral wall of the corresponding through hole 3*a*. As a result, each ignition coil 2 can slide within the range of $\phi A-\phi B$ in an imaginary plane that is perpendicular to the axis of the ignition coil 2. To illustrate the slidably received ignition coil 2, FIG. 3A shows the ignition coil 2 positioned in the center of the receiving through hole 3*a*. Also, FIG. 3B shows the ignition coil 2 positioned in the left side in the receiving through hole 3*a*. Furthermore, FIG. 3C shows the ignition coil 2 positioned in the right side in the receiving through hole 3*a*. It is desirable that the amount of $\phi A-\phi B$ is kept within the tolerance of the corresponding plug hole pitch.

Three base cover through holes 3*b* are provided in the base cover 3. Two of the base cover through holes 3*b* are positioned in the opposed longitudinal ends of the base cover 3, and the last one of the base cover through holes 3*b* is positioned in the center of the base cover 3. Female threads, which are threadably engageable with male threads of a male threaded portion 5*b* of the corresponding fastening bolt 5, are formed along an inner peripheral surface of each base cover through hole 3*b* (see FIG. 4).

Similar to the base cover 3, the top cover 4 is an elongated plate like body made of, for example, a dielectric resin material. A plurality of coil stop protrusions 4*a* is provided in a lower surface of the top cover 4 to protrude downward. The positions of the coil stop protrusions 4*a* correspond to the positions of the ignition coils 2.

Three top cover through holes 4*b* are provided in the top cover 4. Two of the top cover through holes 4*b* are positioned in the opposed longitudinal ends of the top cover 4, and the last one of the top cover through holes 4*b* is positioned in the center of the top cover 4. The top cover through holes 4*b* are arranged coaxially with the corresponding base cover through holes 3*b*.

Each fastening bolt 5 is formed as a hexagonal bolt and includes the head 5*a*, the male threaded portion 5*b* and an underhead portion 5*c*. The head 5*a* is provided at a proximal end of the bolt 5. The male threaded portion 5*b* is provided at a distal end of the bolt 5 and is provided with the male threads, which are threadably engageable with the female threads of the corresponding base cover through hole 3*b*. The underhead portion 5*c* is provided between the head 5*a* and the male threaded portion 5*b* and has an unthreaded smooth outer surface. The axial length of the underhead portion 5*c* is set to be longer than the axial length of the top cover through hole 4*b* (in other words, the thickness of the top cover 4) to allow slide movement of the top cover 4 in the axial direction (i.e., the vertical direction in FIG. 1) of the fastening bolt 5 when each male threaded portion 5*b* is threadably engaged with the female threads of the corresponding base cover through hole 3*b*.

The top cover 4 is installed such that the top cover 4 covers a top surface of the base cover 3. Furthermore, each fastening bolt 5 is received through both the corresponding top cover through hole 4*b* and the corresponding base cover through hole 3*b*, and the male threaded portion 5*b* of the fastening bolt 5 is threadably engaged with the female threads of the corresponding base cover through hole 3*b*. In this way, the top cover 4 and the base cover 3 are temporarily fastened together.

Figure 2:
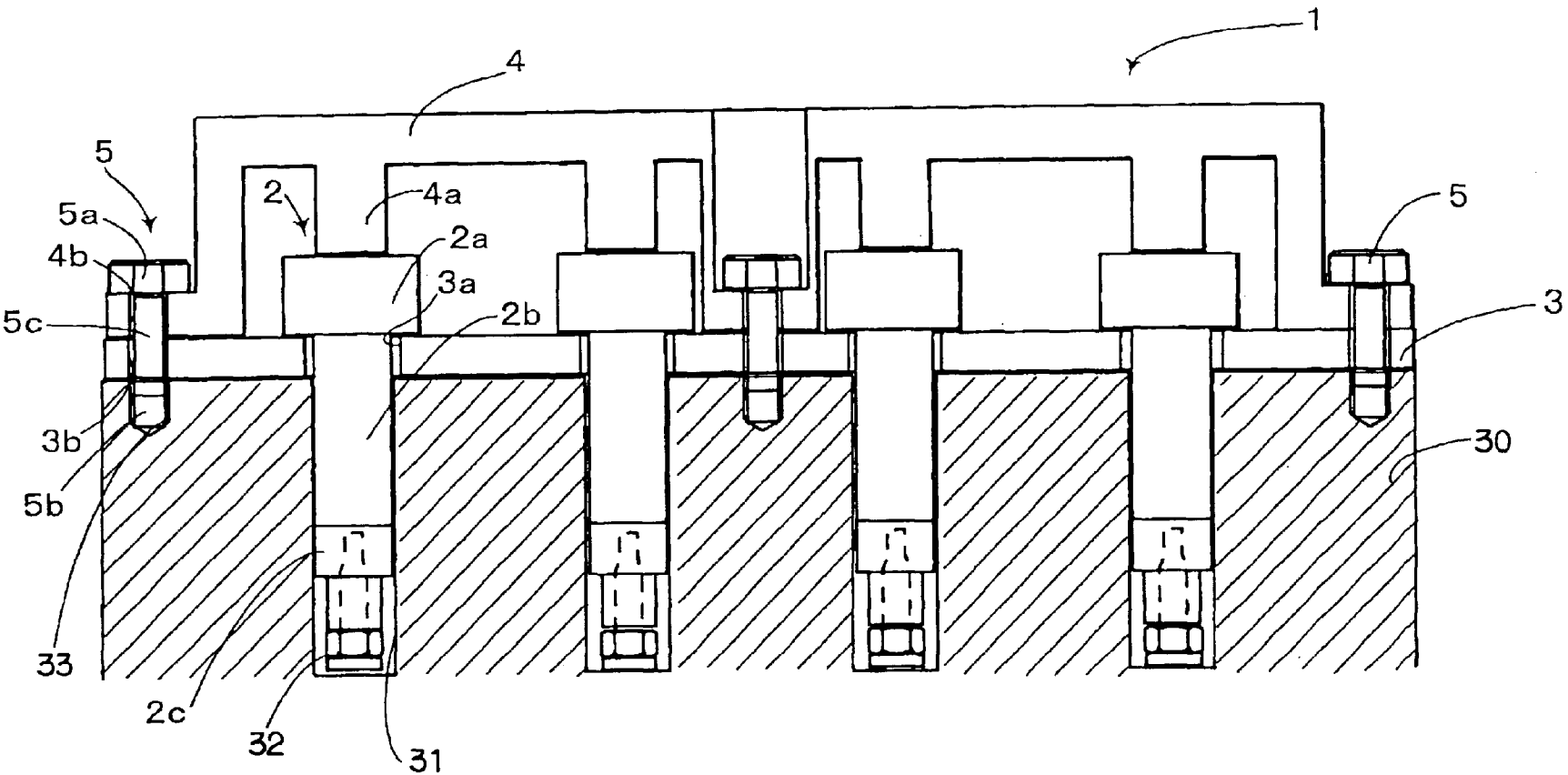
FIG. 2 is a schematic side view showing a state after installation of the ignition coil assembly of the first embodiment into an engine.

Installation procedure of the ignition coil assembly 1 into the engine 30 will be described with reference to FIGS. 1 and 2.

First, as shown in FIG. 1, after the top cover 4 and the base cover 3 are temporarily fastened together by the fastening bolts 5, the ignition coil assembly 1 is placed over the engine 30 such that the ignition coils 2 are aligned with the plug holes 31, respectively, of the engine 30.

Then, the ignition coil assembly 1 is lowered such that each ignition coil 2 is axially inserted into the corresponding plug hole 31, and the base cover 3 is placed on the top surface of the engine 30. Furthermore, the top surface of the top cover 4 is urged downward, so that the inner peripheral surface of the plug cap 2*c* of each ignition coil 2 is engaged with the top end of the corresponding spark plug 32. In this way, the ignition coil 2 and the spark plug 32 are connected to each other. Even if substantial manufacturing error in the hole pitches of the plug holes 31 occurs, each ignition coil 2 can be easily and reliably secured in the corresponding plug hole 31 in the following manner. That is, as described above, the main body 2*b* of each ignition coil 2 is loosely received in the corresponding receiving through hole 3*a* of the base cover 3, and the top cover 4 and the base cover 3 are temporarily fastened by the fastening bolts 5, so that each ignition coil 2 can be inserted into the corresponding plug hole 31 and can abut against the inner peripheral surface of the corresponding plug hole 31 to achieve sliding adjustment of the position of each ignition coil 2 in the imaginary plane that is perpendicular to the axis of the ignition coil 2. Each coil stop protrusion 4*a* located in the lower surface of the top cover 4 is downwardly pressed against the head 2*a* of the corresponding ignition coil 2 to secure the same.

Thereafter, each fastening bolt 5, which is inserted into the corresponding top cover through hole 4*b* and the corresponding base cover through hole 3*b*, is rotated clockwise (i.e., rotated in the tightening direction), so that the male threaded portion 5*b* of each fastening bolt 5 is threaded into the corresponding screw hole 33 of the engine 30, and thereby the top cover 4 and the base cover 3 are integrally secured to the engine 30.

Finally, the connector (not shown) of each ignition coil 2 located at the back side of the head 2*a* is connected to the corresponding connector of the cord connected to the battery (not shown). In this way, installation of the ignition coil assembly 1 into the engine 30 is completed.

As described above, the ignition coils 2 are integrally supported by the base cover 3 and the top cover 4. Furthermore, the ignition coils 2 are oriented in the axial direction of the corresponding plug hole 31 of the engine 30 and are arranged at the intervals, which correspond to the intervals of the plug holes 31 of the engine 30. Thus, the ignition coils 2 can be installed to the engine 30 at once in a single step. As a result, an installation time period required to install the ignition coils 2 is reduced in comparison to the case where the ignition coils 2 are installed one by one.

Furthermore, as described above, the securing position of each ignition coil 2 relative to the top cover 4 and the base cover 3 is slidably adjustable in the imaginary plane that is perpendicular to the axis of the ignition coil 2. Thus, even when the manufacturing error in the hole pitches of the plug holes 31 occurs, each ignition coil 2 can be easily and reliably secured to the corresponding plug hole 31.

Second Embodiment

Figure 5:
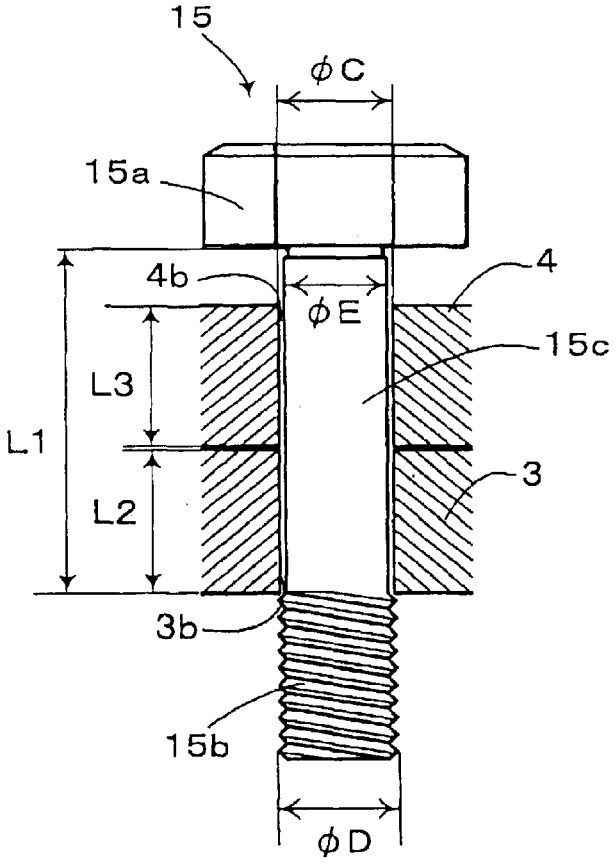
FIG. 5 is an enlarged schematic view showing a structure for temporarily fastening a top cover and a base cover of an ignition coil assembly according to a second embodiment of the present invention.

A second embodiment of the present invention will be described with reference to FIG. 5. Components similar to those discussed with reference to the first embodiment will be indicated by the same numerals and will not be described for the sake of simplicity.

In the second embodiment, the way of temporarily fastening the top cover 4 and the base cover 3 by the fastening bolts is different from that of the first embodiment.

That is, a male threaded portion 15*b* and an underhead portion 15*c* of each fastening bolt 15 of the second embodiment is constructed to satisfy the following relationship:

$$\phi E<\phi C<\phi D$$

where $\phi E$ is the outer diameter of the underhead portion 15*c*, $\phi C$ is the inner diameter of the base cover through hole 3*b*, and $\phi D$ is the outer diameter of the male threaded portion 15*b*. The axial length L1 of the underhead portion 15*c* is longer than the sum of the length L2 of the base cover through hole 3*b* and the length L3 of the top cover through hole 4*b*.

As mentioned above, the outer diameter $\phi D$ of the male threaded portion 15*b* is larger than the inner diameter $\phi C$ of the base cover through hole 3*b*, so that the upper end of the male threaded portion 15*b* of the fastening bolt 15 engages the lower end peripheral edge of the base cover through hole 3*b* to prevent detachment of the base cover 3 and the top cover 4 from the fastening bolt 15. Furthermore, the top cover 4 and the base cover 3 is slidable in the axial direction of the fastening bolt 15 (i.e., the vertical direction in FIG. 5) within a range of L1-(L2+L3). Thus, as described above, the top cover 4 and the base cover 3 are temporarily fastened together by the fastening bolts 15, and the main body 2*b* of each ignition coil 2 is loosely received through the corresponding receiving through hole 3*b* of the base cover 3. As a result, each ignition coil 2 can be slidably adjusted within the imaginary plane that is perpendicular to the axis of the ignition coil 2.

Third Embodiment

Figure 6:
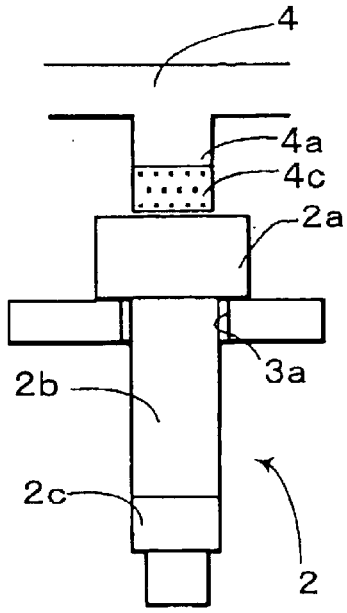
FIG. 6 is an enlarged schematic view showing a structure around a coil stop protrusion of an ignition coil assembly according to a third embodiment of the present invention.

A third embodiment of the present invention will be described with reference to FIG. 6.

In the third embodiment, resilient members are provided in a lower surface of the top cover to engage with the heads of the corresponding ignition coils.

That is, in the third embodiment, a rectangular parallelepiped resilient member 4*c* made of a rubber material is bonded to a distal end of each coil stop protrusion 4*a*. Thus, the top cover 4 downwardly resiliently engages the heads 2*a* of the ignition coils 2 through the resilient members 4*c*. As a result, axial size errors, such a manufacturing error in the depth of each plug hole 31 or a manufacturing error in the length of each ignition coil 2, can be alleviated by the resilient members 4*c*. Therefore, each ignition coil 2 can be relatively easily and reliably installed into the corresponding plug hole 31 of the engine 30.

Fourth Embodiment

A fourth embodiment of the present invention will be described with reference to FIGS. 7A and 7B.

In the fourth embodiment, in addition to the resilient members of the third embodiment, there is provided a structure that prevents rotation of each ignition coil about its axis.

Figure 7A:
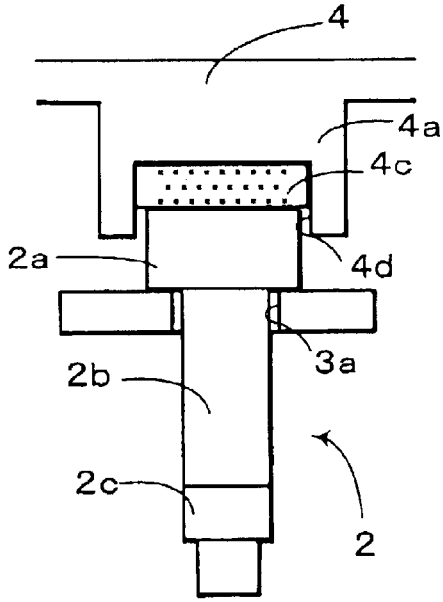
FIG. 7A is an enlarged view showing a structure around a coil stop protrusion of an ignition coil assembly according to a fourth embodiment of the present invention.
Figure 7B:
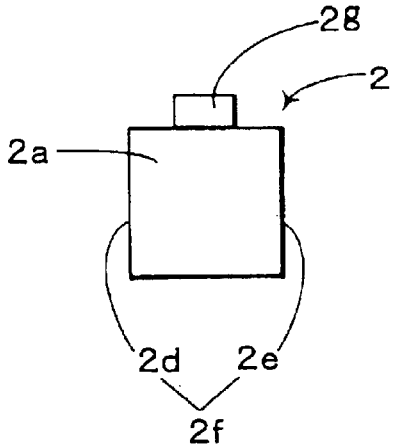
FIG. 7B is a plan view showing a head of a coil of the ignition coil assembly according to the fourth embodiment.
Figure 8:
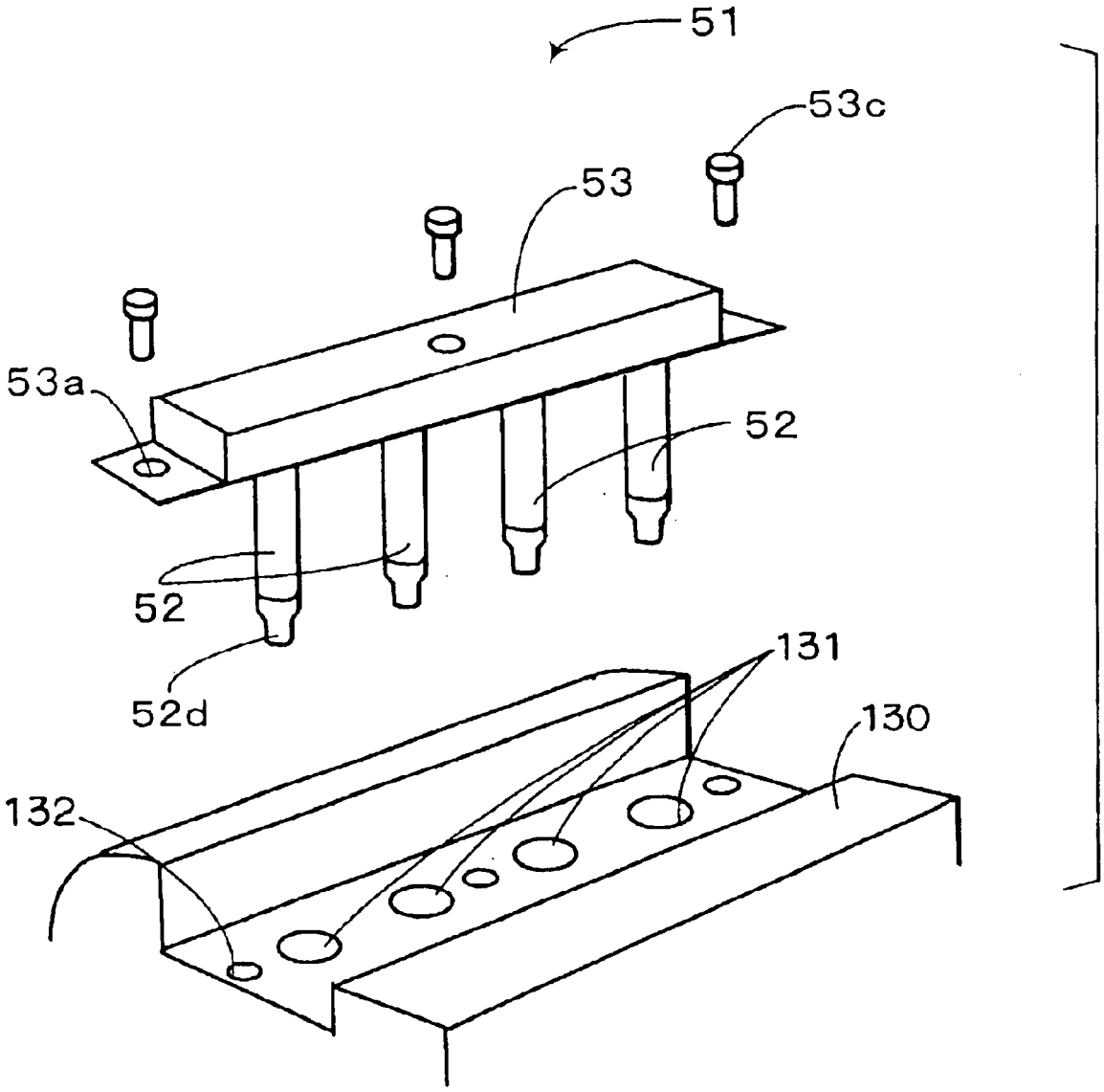
FIG. 8 RELATED ART
FIG. 8 is a schematic perspective view showing a previously proposed ignition coil assembly.

That is, in the present embodiment, as shown in FIG. 7A, each coil stop protrusion 4*a* provided in the lower surface of the top cover 4 has a recess (rotation preventing portion) 4*d*. A resilient member 4*c* made of, for example, a rubber material is received in the recess 4*d* of each coil stop protrusion 4*a*. At least a top part of each head 2*a* of the ignition coil 2 is received in the recess 4*d* of the corresponding coil stop protrusion 4*a*. The top cover 4 is downwardly resiliently engaged with the heads 2*a* of the ignition coils 2 through the resilient members 4*c*. Axial size errors, such a manufacturing error in the depth of each plug hole 31 or a manufacturing error in the length of each ignition coil 2, can be alleviated by the resilient members 4*c*, and thus each ignition coil 2 can be relatively easily and reliably installed into the corresponding plug hole 31 of the engine 30. Furthermore, as shown in FIG. 7B, which is a plan view of the ignition coil 2, the head 2*a* of each ignition coil 2 has a generally square shape when the head 2*a* is seen from its top, as shown in FIG. 7B. Two opposed parallel sides 2*d*, 2*e* of the head 2*a* of the ignition coil 2 form a double sided portion 2*f*. Thus, the double sided portion 2*f* includes two generally flat sides 2*d*, 2*e* that are parallel to each other. The head 2*a* of each ignition coil 2 received in the corresponding recess 4*d* is reliably prevented from rotation about the axis of the ignition coil 2 when the double sided portion 2*f* is engaged with the inner peripheral surface of the recess 4*d*. With this arrangement, the connector 2*g*, which projects laterally from one side of the head 2*a* of each ignition coil 2, can be securely positioned to always orient in a predetermined direction.

It should be noted that the present invention is not limited to the above embodiments, and the above embodiments can be modified in various ways without departing from the spirit and scope of the present invention.

For example, in the above embodiments, the top cover 4 and the base cover 3 are temporarily fastened together by the bolts 5. In place of the bolts, the top cover 4 and the base cover 3 can be temporarily fastened together by any other known connecting members. For example, the top cover 4 and the base cover 3 can be temporarily fastened together by clamping respective overlapped longitudinal ends of the top cover 4 and of the base cover 3 by a corresponding plate spring member in such a manner that the top cover 4 and the base cover 3 are urged toward each other by the plate spring member.

Additional advantages and modifications will readily occur to those skilled in the art. The invention in its broader terms is therefore not limited to the specific details, representative apparatus, and illustrative examples shown and described.

What is claimed is:

1. An ignition coil assembly for an engine, wherein the engine includes a plurality of plug holes, each of which receives a corresponding one of a plurality of spark plugs, the ignition coil assembly comprising:

a plurality of ignition coils that are arranged to be electrically connected to the spark plugs, respectively, wherein each ignition coil includes a head and a main body, which extends from the head;

a base cover that includes a plurality of receiving through holes, which penetrate through the base cover and are arranged at corresponding positions that correspond to positions of the plug holes, respectively, wherein the main body of each ignition coil is received through a corresponding one of the receiving through holes such that a gap is defined between the main body of each ignition coil and an inner peripheral wall of the corresponding one of the receiving through holes, and the head of each ignition coil is supported by the base cover around a peripheral edge of the corresponding one of the receiving through holes;

a top cover that covers a top surface of the base cover and secures each ignition coil through engagement with the head of each ignition coil; and a temporarily fastening member that temporarily fastens the top cover and the base cover in a manner that allows sliding adjustment of a securing position of each ignition coil in an imaginary plane that is perpendicular to an axis of each ignition coil.

2. An ignition coil assembly according to claim 1, wherein:

the engine further includes a screw hole;

the top cover includes a top cover through hole, which penetrates through the top cover;

the base cover includes a base cover through hole, which penetrates through the base cover and is coaxial with the top cover through hole, wherein the base cover through hole includes female threads formed in an inner peripheral surface of the base cover through hole;

the temporarily fastening member is a screw member, which has a male threaded portion at a distal end of the screw member, wherein the screw member is received in both the top cover through hole and the base cover through hole, and the male threaded portion of the screw member is threadably securely engageable with the screw hole of the engine; and the top cover and the base cover are temporarily fastened when the male threaded portion of the screw member is threadably engaged with the female threads of the base cover through hole.

3. An ignition coil assembly according to claim 1, wherein:

the engine further includes a screw hole;

the top cover includes a top cover through hole, which penetrates through the top cover;

the base cover includes a base cover through hole, which penetrates through the base cover and is coaxial with the top cover through hole;

the temporarily fastening member is a screw member, which is received in both the top cover through hole and the base cover through hole and includes:

a head that is located at a proximal end of the screw member;

a male threaded portion that is located at a distal end of the screw member and is threadably securely engageable with the screw hole of the engine; and an underhead portion that is located between the head and the male threaded portion and has an unthreaded smooth outer surface;

a length of the underhead portion is longer than a sum of a length of the top cover through hole and a length the base cover through hole;

an outer diameter of the underhead portion is smaller than an inner diameter of the base cover through hole; and an outer diameter of the male threaded portion is larger than the inner diameter of the base cover through hole.

4. An ignition coil assembly according to claim 1, wherein the top cover includes at least one resilient member placed between the top cover and the heads of the plurality of ignition coils.

5. An ignition coil assembly according to claim 1, wherein the top cover includes a plurality of rotation preventing portions, each of which prevents rotation of the head of a corresponding one of the ignition coils about an axis of the corresponding one of the ignition coils.

6. An ignition coil assembly according to claim 5, wherein:

the head of each ignition coil includes at least one double-sided portion, which includes two generally flat sides that are parallel to each other; and each rotation preventing portion of the top cover includes a recess, which receives at least part of the head of the corresponding one of the ignition coils.

* * * * *